United States Patent [19]

Liu et al.

[11] 3,970,450

[45] July 20, 1976

[54] MODIFIED IRIDIUM-TUNGSTEN ALLOY

[75] Inventors: Chain T. Liu; Henry Inouye, both of Oak Ridge, Tenn.

[73] Assignee: The United States of America as represented by the United States Energy Research and Development Administration, Washington, D.C.

[22] Filed: July 16, 1975

[21] Appl. No.: 596,553

[52] U.S. Cl. ..... 75/172 R; 136/202; 176/91 R

[51] Int. Cl.[2] ..... C22C 5/04

[58] Field of Search ..... 75/172 R; 136/202; 176/91 R

[56] References Cited

UNITED STATES PATENTS

| | | | |
|---|---|---|---|
| 3,262,779 | 7/1966 | Price et al. | 75/172 R |
| 3,767,930 | 10/1973 | Sayell | 136/202 X |

*Primary Examiner*—L. Dewayne Rutledge
*Assistant Examiner*—E. L. Weise
*Attorney, Agent, or Firm*—Dean E. Carlson; David S. Zachry; John B. Hardaway, III

[57] ABSTRACT

A novel iridium alloy composition containing dopant level additions of aluminum, iron, nickel, rhodium and thorium is useful as a containment vessel for isotopic heat sources.

4 Claims, 2 Drawing Figures

MODIFIED IRIDIUM-TUNGSTEN ALLOY

BACKGROUND OF THE INVENTION

This invention was made in the course of, or under, a contract with the Energy Research and Development Administration. It relates generally to a novel iridium base alloy composition, and particularly to an alloy suited for use as an encapsulation material for radioisotope fuels. Radioisotope fuels have found considerable use as both terrestrial and space power sources. Such fuels utilize an isotope which is an alpha, beta, or gamma emitter. Heat is produced from these nuclear emissions and converted into electrical energy by means of thermoelectric generators or thermionic converters.

The most prominent radioisotope fuels at present are $^{238}PuO_2$ and $^{244}Cm_2O_3$. These particular isotopes in the oxide form are desirable because of their refractory properties. The $^{238}PuO_2$ and $^{244}Cm_2O_3$ are generally sintered into spherical balls or cylindrical pellets.

Radioisotopic fuels which are used in space power systems must be encapsulated in a highly reliable material, not only to contain the fuel for normal operation of several years, but to survive launch abort situations, severe aerodynamic heating on re-entry, high velocity impact, and post-impact oxidizing environment. Various alloys have been developed for use as an encapsulation material in this type of environment. These alloys possess many of the desirable characteristics which are needed for such an encapsulation. Prior to the invention herein disclosed, iridium with a small amount of tungsten was the most prominent of the encapsulation alloys.

An iridium alloy containing about 0.3 wt. percent tungsten is currently used as an encapsulation material for a multihundred watt heat source because of its adequate fabricability, fuel compatability and oxidation resistance. This material, however, exhibits only marginal performance in terms of impact resistance under re-entry conditions; i.e., 1400°C at a velocity of about 300 feet per second.

SUMMARY OF THE INVENTION

It is, accordingly, an object of this invention to provide an iridium alloy which is fabricable, resistant to oxidation, and which exhibits enhanced impact properties.

It is another object of this invention to provide an iridium alloy which can be used as the entire encapsulation for an isotopic power source.

It is a still further object of this invention to provide an iridium alloy which is compatible with radioisotope power sources.

These as well as other objects are accomplished by the alloy of this invention which comprises iridium, or conventional iridium 0.3 wt. percent tungsten, doped with aluminum, iron, thorium, nickel, and rhodium.

DETAILED DESCRIPTION

Figure 1:
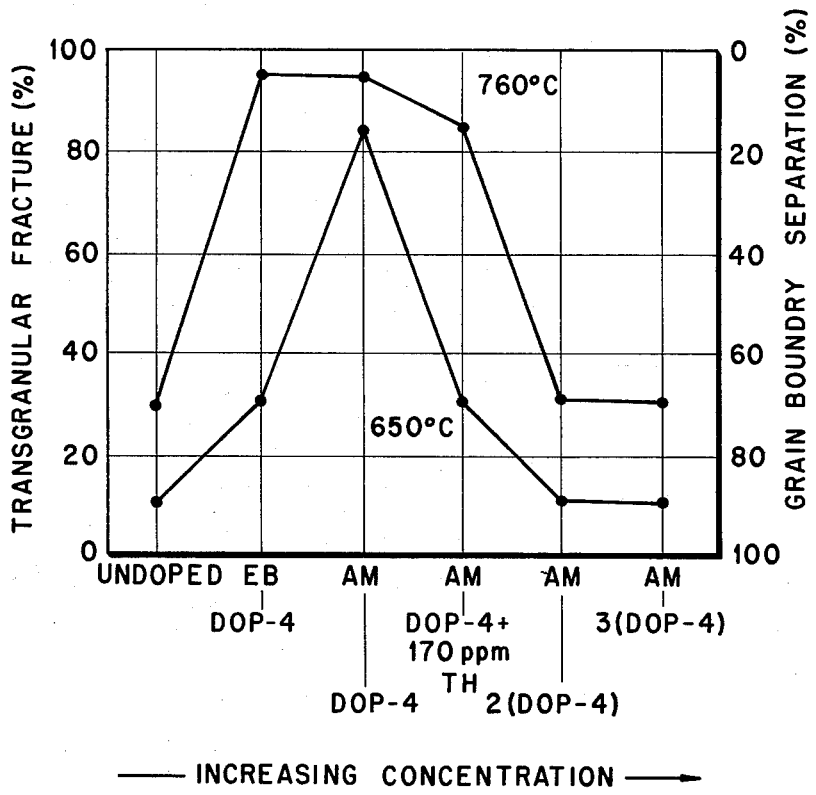
FIGS. 1 and 2 graphically illustrate properties attributable to the dopants and alloy of this invention.

According to this invention, it has been found that dopant level additions of aluminum, iron, thorium, nickel and rhodium to iridium results in an iridium base alloy with synergistically improved grain boundary strength and generally enhanced impact resistance at high strain rates. The dopant additions of this invention improve the mechanical properties of either pure iridium or iridium with about 0.3 wt. percent tungsten. One of the great advantages of the alloy of this invention is that relatively impure iridium may be enhanced by the dopant additions of this invention without the necessity of purification prior to doping.

The alloy in accordance with this invention has dopant concentrations by weight as follows:

| Dopant | Concentration (ppm) |
|---|---|
| Al | 20 – 50 |
| Fe | 20 – 100 |
| Ni | 5 – 20 |
| Rh | 50 – 100 |
| Th | 15 – 50 |

The preferred or optimum concentrations within the above ranges is:

| Dopant | Concentration (ppm) |
|---|---|
| Al | 40 |
| Fe | 80 |
| Ni | 16 |
| Rh | 75 |
| Th | 30 |

At room temperature, undoped iridium or iridium with tungsten shows mainly a grain boundary separation mode of failure while the doped alloys of this invention exhibit a mixture of grain boundary separation and transgranular fracture at low strain rates. At 650°C grain boundary separation is the dominant mode of fracture for undoped material, while mainly transgranular fracture with minor grain boundary separation is primarily the fracture mode for doped material. At 760°C undoped iridium shows a mixture of grain boundary separation with minor transgranular fracture while the doped alloys exhibit completely transgranular fracture. Thus the dopants of this invention strengthen grain boundaries and suppress intergranular fracture. Thorium has been found to be the most beneficial of the additives. Tantalum, on the other hand, at levels of greater than about 30 ppm has been found to be highly detrimental and must be avoided if the desirable characteristics of this invention are to be achieved.

Some of the dopants utilized in the compositions of this invention are normally present as impurities in commercial quality iridium. The preferred method of preparing the doped alloy of this invention from the impure material is to analyze the impure material by the spark-source-mass-spectrometric method. Having once ascertained the impurity levels of the material, dopants are added to the material so as to bring the composition into the desired range. However, if the material is so impure as to be above the dopant concentration ranges of this invention, some technique of purification must be resorted to. The purification method disclosed in U.S. Pat. No. 3,867,137, which is hereby incorporated by reference, is the preferred method of purification.

The doped alloy of this invention is best prepared by arc melting the appropriate powders. Electron beam melting may also be used. Of the two techniques, however, the arc melting method is preferred because of the considerably fewer dopant losses which accompany the melting process. Once an ingot is prepared by arc melting, the preferred method of fabricating sheet from the ingot is to hot roll the ingot between 900° and 1200°C with an intermediate anneal at 1200°C.

Articles produced from iridium having the dopants in accordance with this invention have an elongated grain structure with ASTM grain size 6 as compared to equiaxed grain structure with an ASTM grain size of 3 to 4 for the undoped material. It has been found that the fine and elongated grain structure partly contributes to the enhanced mechanical properties of the doped alloy. The doped alloy also exhibits an increase in recrystallization temperature of about 150°C, which thus improves the quality of the alloy sheet after fabrication.

Having generally set forth the alloy of this invention, the following illustrative examples are given as a further aid to the understanding thereof.

EXAMPLE I

Iridium-0.3% W alloy powder compacts containing the materials specified in Table I were sintered for 1 hour in $H_2$ at 1000°C followed by 4 hours in vacuum at 1500°C. The compacts were then melted by either arc melting or electron beam melting and cast into 150-g rectangular ingots. The alloy ingots were then clad in molybdenum jackets and hot rolled between 1200°–1250°C with 15% reduction per pass. After a total reduction of 65%, the alloy plates were softened by heat treatment for 1 hour at 1200°C and further rolled to 0.025 inch thick sheet between 900°–1000°C. The DOP-4 alloy sheet produced in this manner had good quality with no indication of surface or end cracks. Table I compares the compositions of arc melted DOP-4 alloy sheet with those of DOP-4 sheet prepared by electron beam melting and the DOP-7 alloy sheet containing double the amount of DOP-4 dopants prepared by arc-melting.

TABLE I

Spark-Source-Mass-Spectrometric Analysis[a] of Doped and Undoped Ir-0.3% W Alloys

| Element | Undoped Analyzed | DOP-4 Doped | DOP-4 Analyzed[b] | DOP-4 Analyzed[c] | DOP-7 Doped | DOP-7 Analyzed[b] |
|---|---|---|---|---|---|---|
| Al | 5 | 40 | 20 | 10 | 80 | 78 |
| B | 0.5 | 0.1 | 0.5 | | | <0.1 |
| Ca | 1 | | 0.1 | 1 | | 1 |
| Co | 0.1 | | 1 | <0.3 | | 1 |
| Cr | 5 | | 15 | 3 | | 20 |
| Cu | 1 | | 7 | 20 | | 10 |
| Fe | 5 | 80 | 50 | 15 | 160 | 150 |
| Ir | M | | M | M | | M |
| K | 3 | | <1 | 1 | | 20 |
| Mg | <1 | | <1 | <1 | | 0.3 |
| Mn | 0.1 | | 0.5 | 0.3 | | 1 |
| Mo | 10 | | 3 | 10 | | 1 |
| Na | 5 | | | <0.5 | | 0.5 |
| Ni | 1 | 16 | 20 | 5 | 32 | 50 |
| P | 0.1 | | <0.5 | 1 | | 0.3 |
| Rh | 20 | 75 | 100 | 70 | 150 | 100 |
| Ru | 20 | | 15 | 50 | | 1 |
| Si | 5 | | 40 | 5 | | 3 |
| Ta | 10 | | 10 | 10 | | 50 |
| Th | 0 | 30 | 20 | 20 | 60 | 50 |
| V | 3 | | 2 | 3 | | 10 |
| W | 2500 | | 3000 | 2500 | | 3000 |
| Zn | <0.3 | | <1 | 0.3 | | 3 |
| Zr | 5 | | <1 | 1 | | 1 |

[a]In weight, parts per million.
[b]Alloy prepared by arc melting.
[c]Alloy prepared by electron beam melting.

EXAMPLE II

Test alloys were prepared, using substantially pure Ir-0.3% W as a base, incorporating small additions of Al, Fe, Ta, Th, Rh, and Ni as in Example I. The choice of these elements was based on the dependence of the fracture behavior on the impurity levels in various iridium alloy heats. Both arc-melted and electron beam melted ingots were prepared using varying amounts of the dopants. Two series of experimental alloys were produced: the first having six alloys and the second three alloys. The concentration of the dopants are listed in Table II. The ingots were rolled into sheets from which test specimens were produced. In particular, tensile specimens were produced which were recrystallized for 1 hour at 1500°C prior to testing for strength and ductility at room temperature, 650°C, 760°C, 1093°C, and 1370°C. The fracture behavior of the eight doped alloys tested at a strain rate of $10^{-4}$ $sec^{-1}$ are listed in Table III where they are compared with an undoped alloy. Some of these data are used to plot the curves of FIG. 1 which demonstrates the effect iof dopant concentration on fracture behavior. As indicated in FIG. 1, the dopant concentration which most effectively strengthens the grain boundary and suppresses the brittle intergranular fracture at the moderate temperature is near the DOP-4 level. Complete tensile properties of doped (DOP-4) and undoped alloys prepared by the same method are presented in Table IV.

TABLE II

Ir-0.3% W Alloys Doped with Selected Elements (ppm by wt)

| Dopant Element | Heat Number, DOP- First Series 0[a] | 1 | 2 | 3 | 4 | 5 | Second Series 6[b] | 7[c] | 8[d] |
|---|---|---|---|---|---|---|---|---|---|
| Al | 0 | 40 | 0 | 40 | 40 | 40 | 40 | 80 | 120 |
| Fe | 0 | 80 | 80 | 0 | 80 | 80 | 80 | 160 | 240 |
| Ta | 0 | 31 | 31 | 31 | 0 | 31 | 0 | 0 | 0 |
| Th | 0 | 30 | 30 | 30 | 30 | 0 | 200 | 60 | 90 |
| Ni | 0 | 16 | 16 | 16 | 16 | 16 | 16 | 32 | 48 |
| Rh | 0 | 75 | 75 | 75 | 75 | 75 | 75 | 150 | 225 |

[a]Undoped Ir-0.3% W Alloy.
[b]DOP-4 Dopants plus 170 ppm Th.
[c]Double amount of DOP-4 Dopants.
[d]Triple amount of DOP-4 Dopants.

TABLE III

Fracture Behavior[a] of Doped and Undoped Ir-0.3% W Alloys[b] at Room Temperature, 650°C and 760°C

| Heat Number | Fracture Mode[c] RT | 650°C | 750°C |
|---|---|---|---|
| DOP-0 | Mainly GBS | Mainly GBS | GBS(Ma) & TF(Mi) |
| -1 | GBS(Ma) & TF(Mi) | TF(Ma) & GBS(Mi) | Completely TF |
| -2 | " | " | " |
| -3 | " | " | " |
| -4 | " | Mainly TF | " |
| -5 | " | TF & GBS | Mainly TF |
| -6 | Mainly GBS | GBS(Ma) & TF(Mi) | " |
| -7 | " | Mainly GBS | GBS & TF |
| -8 | " | " | " |

[a]Specimens Fractured in Tension at a Crosshead Speed of 0.1 to 0.2 in/min.
[b]Specimens Recrystallized 1 hr at 1500°C.
[c]GBS = Grain-Boundary Separation, TF = Transgranular Fracture, Mi = Minor Fraction, Ma = Major Fraction.

TABLE IV

Tensile Properties of Doped and Undoped Ir-0.3% W Sheet Materials[a] Fabricated from the Same Batch of Ir Powder

| Heat Number | Strength, ksi Yield | Tensile | Elongation(%) | Fracture Mode[b] |
|---|---|---|---|---|
| | | Room Temperature | | |
| Undoped[c] | 11.8 | 62.6 | 14.2 | Mainly GBS |
| DOP-4[c] | 15.8 | 72.6 | 15.3 | " |
| DOP-4[c] | 13.8 | 70.4 | 15.6 | " |
| | | 650°C | | |
| Undoped | 7.4 | 70.8 | 30.1 | Mainly GBS |
| DOP-4 | 10.0 | 80.3 | 36.0 | GBS (Ma) and TF (Mi) |
| DOP-4 | 9.3 | 78.8 | 35.7 | " |
| | | 760°C | | |
| Undoped | 6.8 | 64.0 | 39.3 | GBS (Ma) and TF (Mi) |
| DOP-4 | 8.8 | 68.8 | 50.0 | Completely TF |
| DOP-4 | 8.6 | 67.5 | 47.1 | " |
| | | 1093°C | | |
| Undoped | 6.7 | 36.2 | 55.6 | Ductile Rupture |
| DOP-4 | 8.1 | 40.7 | 58.2 | " |
| DOP-4 | 8.7 | 38.9 | 58.8 | " |
| | | 1370°C | | |
| Undoped | 5.6 | 25.8 | 55.2 | Ductile Rupture |
| DOP-4 | 6.7 | 27.8 | 60.7 | " |
| DOP-4 | 5.9 | 27.2 | 58.1 | " |

[a]Specimens annealed 1 hr at 1500°C, tested in tension at a cross-head speed of 0.1 - 0.2 in/min.
[b]GBS denotes "grain boundary separation", TF denotes "transgranular fracture", (Ma) denotes "major fraction", (Mi) denotes "minor fraction".
[c]Alloy prepared by electron beam melting and drop casting.

Figure 2:
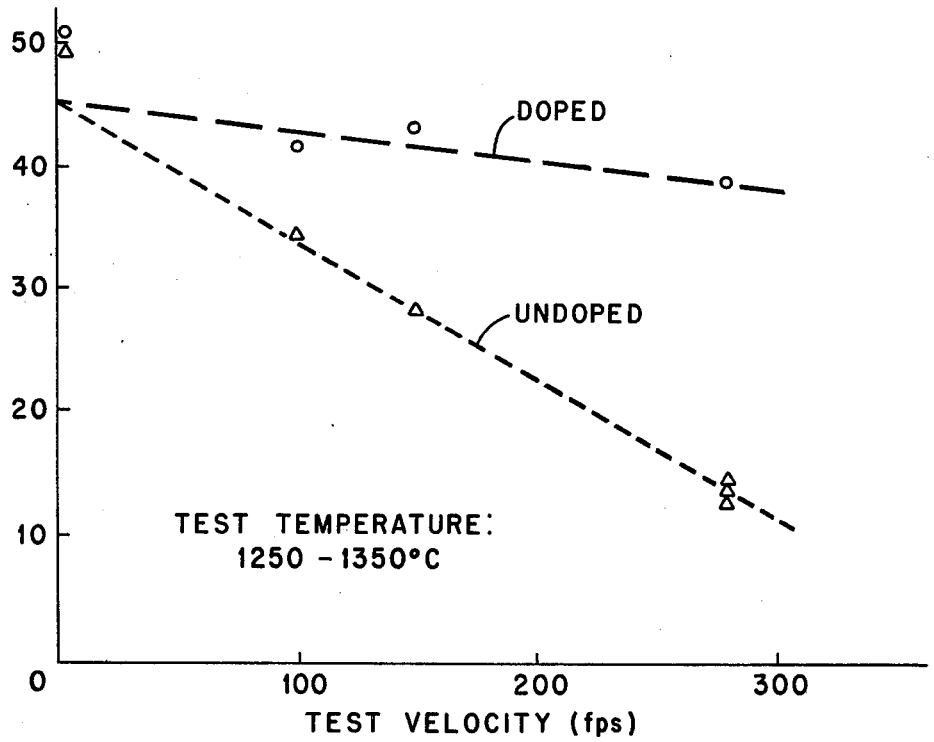

The mechanical properties of DOP-4 and undoped Ir-0.3% W alloys were also determined at high test velocities. The results of these tests are summarized in Table V and FIG. 2 as a function of test velocity. The plot in this figure indicates that the elongation of undoped specimens decreases linearly with test velocities at a rate of about 12% per 100 fps, and that the specimens lose most of their ductility at a velocity near 300 fps - the approximate impact velocity of an isotopic containment vessel. Accompanying the decrease in ductility, the undoped alloy starts to show brittle intergranular fracture and surface cracks at velocities above 100 fps. Thus it is seen that the tensile impact properties of the undoped alloy depend strongly on test velocity.

TABLE V

Effect of Test Velocity on Tensile Impact Properties of DOP-4 and Undoped Ir-0.3%W Sheet Specimens Annealed at 1500°C for 1 Hr.

| Test Velocity (fps) | Test Temperature (°C) | Elongation (%) | Reduction in Area (%) | Fracture[a] Mode | Surface Cracks |
|---|---|---|---|---|---|
| | | Undoped Specimens | | | |
| 280 | 1250 | 13.5[b] | 27.0[b] | Mainly GBS | Many |
| 150 | 1350 | 27.8 | 36.7 | TF(Ma) & GBS (Mi) | Few |
| 100 | 1350 | 34.3 | 40.2 | Mainly TF | Very Few |
| | | DOP-4 Specimens | | | |
| 280 | 1250 | 38.2[c] | 82.0[c] | DR | None |
| 150 | 1350 | 43.1 | 94.0 | DR | None |
| 100 | 1350 | 41.5 | 75.0 | DR,TF | None |

[a]GBS = grain-boundary separation; TF = transgranular fracture; Ma = major fraction; Mi = minor fraction; DR = ductile rupture.
[b]Average from three specimens.
[c]Average from two specimens.

In contrast, the impact properties of DOP-4 specimens (in terms of fracture mode, surface cracking, and reduction in area) do not depend on test velocity. The elongation may decrease slightly with test velocity, but DOP-4 still had 38.2% elongation when impacted at 280 fps at 1250°C. Intergranular fracture was not observed in the impacted DOP-4 specimens indicating the strengthening of grain boundaries by the dopants. As a consequence, DOP-4 has impact properties much superior to those of undoped alloys.

EXAMPLE III

Three spherical test units fabricated from DOP-4 Ir-0.3% W were subjected to re-entry conditions. These were impacted against a solid body at 285 feet/sec. at a temperature of 1400°C. None of these units fractured or showed the "fingerprint" type of cracks frequently seen on undoped units. This success may be compared with undoped Ir-0.3% W units which failed most of the impact tests.

What is claimed is:

1. An iridium base alloy composition having enhanced impact resistance comprising by weight 20 to 50 ppm aluminum;
20 to 100 ppm iron;
5 to 20 ppm nickel;

50 to 100 ppm rhodium;
15 to 50 ppm thorium; and iridium as the balance.

2. The alloy according to claim 1 further comprising 0.3 wt. percent tungsten.

3. The alloy according to claim 1 comprising
40 ppm aluminum;
80 ppm iron;

16 ppm nickel;
75 ppm rhodium;
30 ppm thorium; and iridium as the balance.

4. The alloy according to claim 3 further containing 0.3 wt. percent tungsten.

* * * * *